United States Patent [19]

Dreckmann et al.

[11] Patent Number: 4,631,047

[45] Date of Patent: Dec. 23, 1986

[54] APPARATUS FOR CUTTING HAND HOLES IN BAGS

[75] Inventors: Karl Dreckmann, Hennef-Altenbödingen; Theo Miesen, Niederkassel-Rheidt, both of Fed. Rep. of Germany

[73] Assignee: Lemo M Lehmacher & Sohn GmbH Maschinenfabrik, Niederkassel, Fed. Rep. of Germany

[21] Appl. No.: 808,890

[22] Filed: Dec. 13, 1985

[30] Foreign Application Priority Data

Dec. 14, 1984 [DE] Fed. Rep. of Germany ..... 3445660

[51] Int. Cl.[4] ..... B31B 1/20; B26F 1/44

[52] U.S. Cl. ..... 493/227; 493/364; 493/926; 83/188; 83/192

[58] Field of Search ..... 83/188, 192; 493/227, 493/926, 364, 363, 226, 472; 53/384

[56] References Cited

U.S. PATENT DOCUMENTS

| | | | |
|---|---|---|---|
| 3,698,274 | 10/1972 | Coulon et al. | 83/188 |
| 3,802,308 | 4/1974 | Davis | 83/192 X |
| 3,848,497 | 11/1974 | Lancaster et al. | 83/192 |
| 4,031,815 | 6/1977 | Verbeke | 493/226 X |
| 4,386,924 | 6/1983 | Crawford et al. | 493/926 X |
| 4,398,903 | 8/1983 | Lehmacher | 493/227 X |

*Primary Examiner*—Donald R. Schran

*Attorney, Agent, or Firm*—Karl F. Ross; Herbert Dubno

[57] ABSTRACT

An apparatus for forming aligned front and rear hand holes in the front and rear panels of a bag according to the invention has a support having a front face and an oppositely directed rear face adapted to respectively support the front and rear panels of the bag and formed with respective aligned front and rear annular recesses of a shape corresponding to that of the hand holes to be cut. Respective annular front and rear outer holddowns are engageable with the respective faces for pressing the respective panels thereagainst around the respective recesses. An annularly continuous front cutter blade is engageable in the front recess and an annular but discontinuous rear cutter blade is engageable in the rear recess. A rear inner holddown is also engageable with the rear face within the recess. An actuator can press the holddowns against the respective faces and simultaneously press the blades into the respective recesses and thereby cut a piece from the front panel and form an annular but discontinuous cut in the rear panel.

5 Claims, 5 Drawing Figures

APPARATUS FOR CUTTING HAND HOLES IN BAGS

FIELD OF THE INVENTION

The present invention relates to an apparatus for cutting hand holes in a bag. More particularly this invention concerns such an apparatus which cuts aligned hand holes in synthetic-resin shopping bags.

BACKGROUND OF THE INVENTION

An apparatus for forming aligned front and rear hand holes in the front and rear panels of a bag normally has a support having a face on which the two panels of the bag are supported and formed with a a recess of a shape corresponding to that of the hand holes to be cut. A holddown presses the two panels against the support around the recess and an annularly continuous cutter blade is pressed through the panels into the recess. This cuts two identical holes in the panels in perfect alignment with each other. A suction device is normally provided to carry off the piece cut out to form these hand holes.

This procedure can be carried out on the finished bag. It can also be done on two individual panels yet to be welded together at the edges to form a bag or on a tube yet to be cut and welded to form a bag.

The disadvantage of this arrangement is that the subsequent packaging of the bags is frequently complicated. This is particularly the case when the bags are to be packaged together so that the top one can be torn off easily.

OBJECTS OF THE INVENTION

It is therefore an object of the present invention to provide an improved apparatus for cutting hand holes in a bag.

Another object is the provision of such a apparatus for cutting hand holes in a bag which overcomes the above-given disadvantages, that is which produces a bag that is particularly adapted to efficient packaging.

SUMMARY OF THE INVENTION

An apparatus for forming aligned front and rear hand holes in the front and rear panels of a bag according to the invention has a support having a front face and an oppositely directed rear face adapted to respectively support the front and rear panels of the bag and formed with respective aligned front and rear annular recesses of a shape corresponding to that of the hand holes to be cut. Respective annular front and rear outer holddowns are engageable with the respective faces for pressing the respective panels thereagainst around the respective recesses. An annularly continuous front cutter blade is engageable in the front recess and an annular but discontinuous rear cutter blade is engageable in the rear recess. A rear inner holddown is also engageable with the rear face within the recess. An actuator can press the holddowns against the respective faces and simultaneously press the blades into the respective recesses and thereby cut a piece from the front panel and form an annular but discontinuous cut in the rear panel.

Thus with the system of this invention the hand hole is not completely cut out of the rear panel. Instead a piece is left here which is connected to the rest of the rear panel by small fragile webs so it can readily be removed. It therefore is possible to stack such bags and to staple them together at the hand holes, forming a neat package from which the top bag can easily be separated simply by pulling it and tearing out the piece in the rear hand hole.

According to another feature of this invention the support is formed within the recesses with at least one throughgoing hole and the upper blade is provided with punches engageable through the hole with the rear panel and into a corresponding hole in the rear inner holddown. This makes it possible to stack the bags with the hang holes formed by these punches aligned to allow a pack of the bags to be hung up. The user can free a bag, which will normally hang open with the front panel loose, simply by pulling it loose, leaving the piece from the rear panel behind.

Means is also provided according to this invention for carrying away the piece cut by the front blade from the front panel. A vacuum arrangement working in conjunction with the punches can carry away the pieces pushed out by these punches.

The inner holddown is carried on the rear outer holddown by springs so these parts can move relative to each other. In addition the inner and outer rear holddowns define an annular gap having a width equal generally to twice the thickness of the rear blade.

DESCRIPTION OF THE DRAWING

The above and other features and advantages will become more readily apparent from the following, reference being made to the accompanying drawing in which.

SPECIFIC DESCRIPTION

Figure 1:
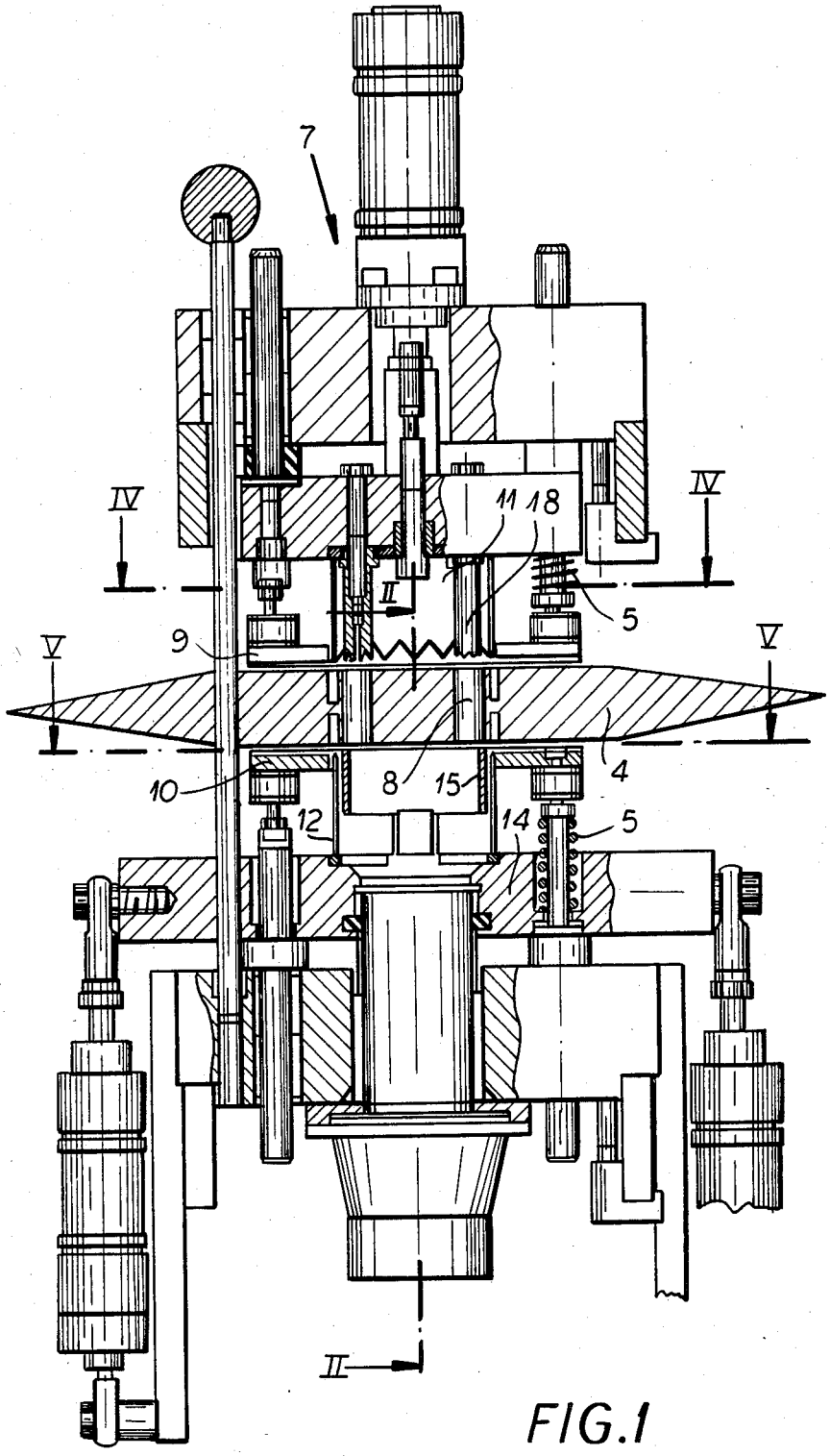
FIG. 1 is a vertical section through the apparatus according to this invention.
Figure 2:
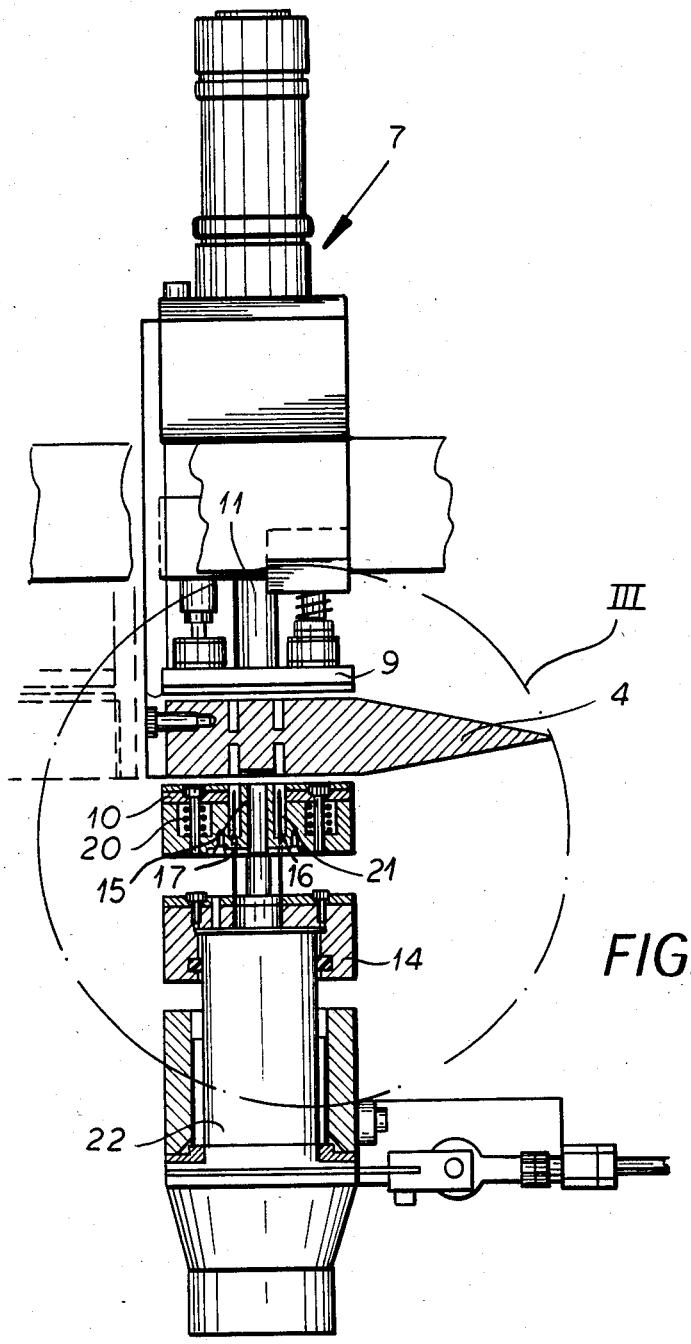
FIG. 2 is a vertical section taken along line II—II of FIG. 1.
Figure 3:
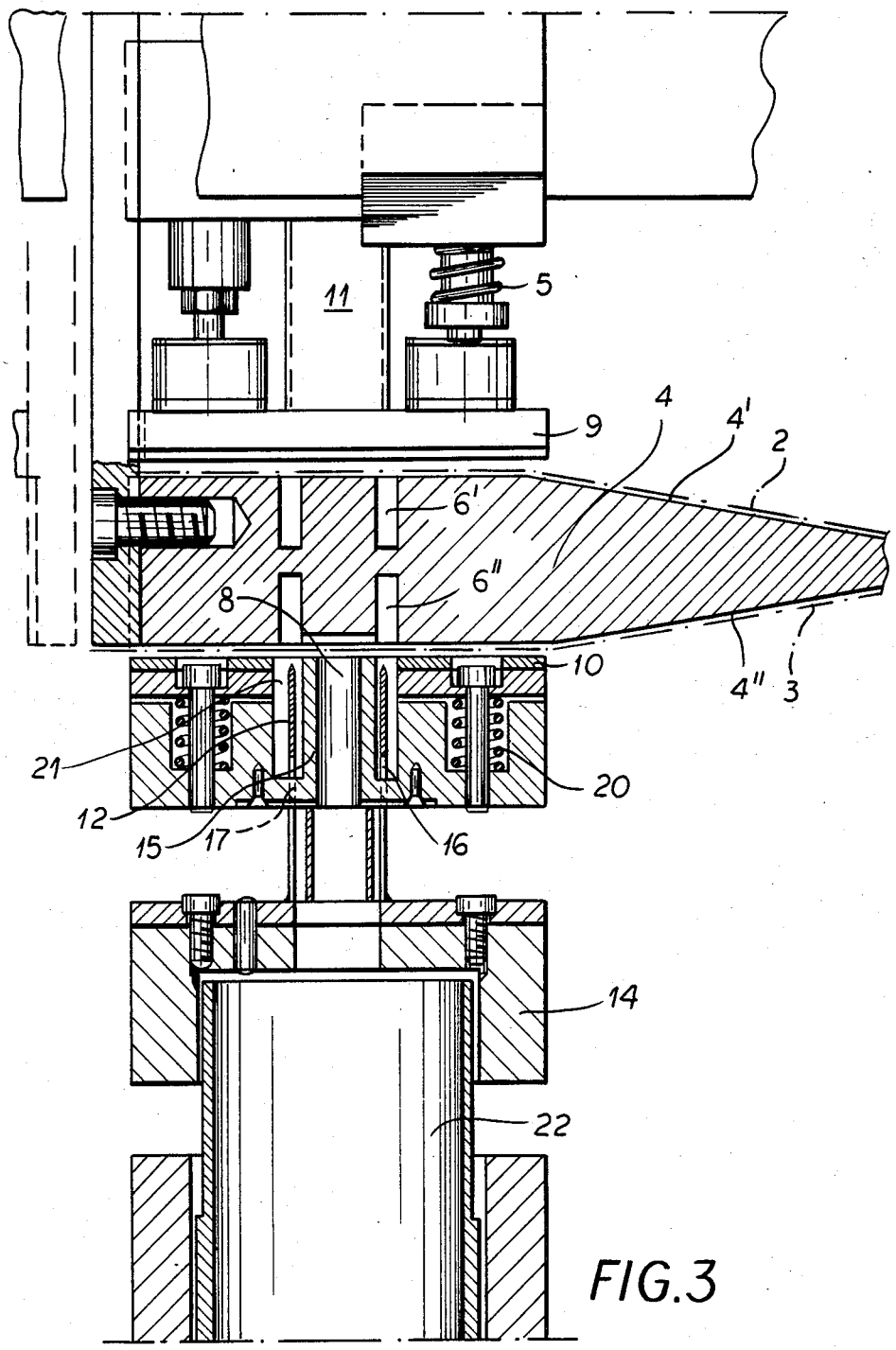
FIG. 3 is a large-scale view of the detail indicated at III in FIG. 2.

As seen in the drawing the apparatus according to this invention serves to cut hand holes 1 in front and rear panels 2 and 3 of a bag 2, 3. This apparatus has a support or die 4 with a front or upper face 4' and a rear or lower face 4'' and is formed with an upwardly open annular recess 6' and a downwardly open annular recess 6'' in vertical registration therewith. These recesses 6'an 6'' are shown to be of rounded sickle shape, but can be round, square, or any other desired shape. The bag 2, 3 is fitted over the support die 4 with its upper or front panel 2 lying on the upper face 4' and its lower or rear panel 3 under the rear face 4''.

Figure 4:
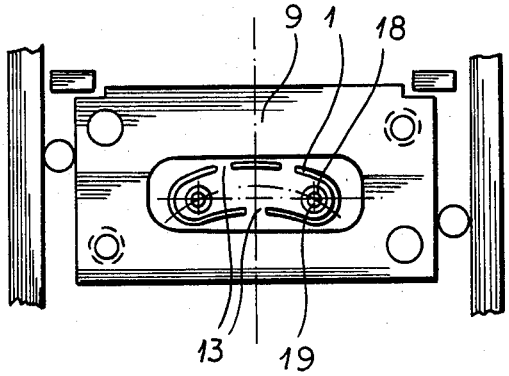
FIGS. 4 and 5 are horizontal sections taken along respective lines IV—IV and V—V of FIG. 1.
Figure 5:
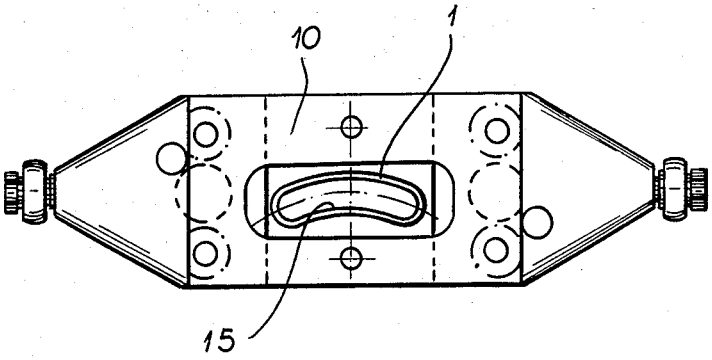

Upper and lower holddowns 9 and 10 (FIGS. 4 and 5) engageable with the upper and lower faces 4' and 4'' around the recesses 6' and 6'' are carried via springs 5 on respective actuators 7 and 14. These holddowns 9 and 10 can therefore be pressed against the panels 2 and 3 to hold them snugly in place on the faces 4' and 4''. Upper and lower annular blades 11 and 12 within the holddowns 9 and 10 are also moved by the actuators 7 and 14 and can engage through the panels 2 and 3 in the recesses 6' and 6''. The lower blade 12 is formed as seen in FIG. 4 with discontinuous regions or gaps 13 so that it will not cut a piece out of the lower panel 3, but instead will simply form an annularly discontinuous cut leaving a piece still connected via small easily torn webs to the panel 3.

The lower blade 12 is also formed with holes 16 through which pass webs 17 supporting an inner lower holddown 15 on the outer lower holddown 10, with springs 20 being provided to allow some relative movement between the inner and outer lower holddowns 15 and 10. An annular gap 21 is formed between these inner and lower holddowns for the blade 12 which has a width equal to about twice the thickness of the lower blade 12.

Inside the upper continuous blade 11 are a pair of punches 18 that can engage in holes 8 through the support 4 and inner lower holddown 15 to form hanging holes 19 in the tearout piece left by the blade 12. A vacuum arrangement 22 is provided to carry off the pieces cut out by the upper blade 11 and by the punches 18.

Thus the apparatus of this invention will cut a piece out of the front panel 2 and will form in the rear panel 3 a piece that can be used to secure together and hang a plurality of the bags, but his piece can readily be torn loose to free the bag from the pack.

We claim:

1. An apparatus for forming aligned front and rear hand holes in the front and rear panels of a bag, the apparatus comprising:

a support having a front face and an oppositely directed rear face adapted to respectively support the front and rear panels of the bag and formed with respective aligned front and rear annular recesses of a shape corresponding to that of the hand holes to be cut;

respective annular front and rear outer holddowns engageable with the respective faces for pressing the respective panels thereagainst around the respective recesses;

an annularly continuous front cutter blade engageable in the front recess;

an annular but discontinuous rear cutter blade engageable in the rear recess;

a rear inner holddown engageable with the rear face within the recess; and actuator means for pressing the holddowns against the respective faces and for simultaneously pressing the blades into the respective recesses and thereby cutting a piece from the front panel and forming an annular but discontinuous cut in the rear panel.

2. The apparatus defined in claim 1 wherein the support is formed within the recesses with at least one throughgoing hole and the upper blade is provided with punches engageable through the hole with the rear panel.

3. The apparatus defined in claim 1, further comprising means for carrying away the piece cut by the front blade from the front panel.

4. The apparatus defined in claim 1, further comprising spring means supporting the inner holddown on the rear outer holddown for limited relative movement.

5. The apparatus defined in claim 1 wherein the inner and outer rear holddowns define an annular gap having a width equal generally to twice the thickness of the rear blade.

* * * * *